United States Patent [19]

Johnson

[11] Patent Number: 5,037,094

[45] Date of Patent: Aug. 6, 1991

[54] BASEBALL HITTING INSTRUCTIONAL DEVICE

[75] Inventor: Elliot O. Johnson, 4539 Artelia Dr., Antioch, Tenn. 37013

[73] Assignee: Elliot Johnson, Antioch, Tenn.

[21] Appl. No.: 605,531

[22] Filed: Oct. 29, 1990

[51] Int. Cl.[5] ..... A63B 69/00

[52] U.S. Cl. ..... 273/26 R; 273/188 A

[58] Field of Search ..... 273/26 R, 32 C, 187 R, 273/188 A, 187 B

[56] References Cited

U.S. PATENT DOCUMENTS

| | | | |
|---|---|---|---|
| 2,189,613 | 2/1940 | Paulsen | 273/187 B |
| 3,342,487 | 9/1967 | David | 273/26 R |
| 3,350,096 | 10/1967 | Kile et al. | 273/26 R |
| 3,372,930 | 3/1968 | Sertich | 273/26 R |
| 3,466,040 | 9/1969 | Sertich | 273/26 R |
| 3,815,906 | 6/1974 | Hermo | 273/26 R |
| 4,225,133 | 9/1980 | Kiray | 273/26 R |
| 4,322,084 | 3/1982 | Reece | 273/187 B |
| 4,516,772 | 5/1985 | Stratton . | |
| 4,664,375 | 5/1987 | Tetreault | 273/26 R |
| 4,932,656 | 6/1990 | Pierce | 273/26 R |

*Primary Examiner*—Theatrice Brown

[57] ABSTRACT

A base containing regulatory foot placement devices upon which a hitter stands when hitting a pitched ball. The ball of the back foot is rotated upon a revolving disc as the heel is lifted to clear a small barrier as the foot turns. An adjustable stride regulator prevents an overstride of the front foot, while an adjustable stride guide requires the front foot to reach the proper destination in relation to home plate. A scale records stride length and directional arrows indicate optimal back foot pivot per pitch location.

4 Claims, 3 Drawing Sheets

BASEBALL HITTING INSTRUCTIONAL DEVICE

BACKGROUND

1. Field of Invention

This invention relates to the proper foot placement in hitting a pitched baseball or softball, specifically the forward stride of the front foot and the pivot on the ball of the back foot.

2. Description of Prior Art

Baseball and softball coaches constantly attempt to verbally communicate the proper footwork to be employed in making solid contact with a pitched ball. Nevertheless, both the novice and the most advanced hitters have difficulty learning the proper footwork. Hitters continually stride away from home plate. They evert the front foot at far too great an angle, thus forcing the hips to rotate towards the pitcher prematurely. They fail to pivot on the rear foot, or if they do pivot, fail to lift the back heel to force the weight foreward towards the pitcher.

Verbal clues are good, but even when players are told accurately they have trouble implementing the advice. Visual aids are also good, but the player still must "feel" the sensation of correct footwork for himself before the proper habit pattern becomes ingrained.

Heretofore, practitioners have spent the bulk of their time using video-taped instruction. The physical involvement has been limited to placing a bat on the ground behind the hitter and telling him to avoid stepping on it as he strides. Or, coaches have drawn a line in the dirt and advised against overstepping the mark. Gillespie has invented a "Stride Tutor", consisting of a velcro band fastened to each ankle and connecting each foot via a chain to restrict stride length. Scannell has invented a "Hip Helper" which is strapped to the rear foot and rotates one-quarter turn, thereby facilitating hip rotation. Ward has simply constructed rectangular frames of wood to surround the feet of hitters. He built various sized frames to accomodate different sizes of players. These are but partial solutions which suffer the following disadvantages:

a. No invention prevents a hitter from stepping "in the bucket" or away from home plate.
b. The first two inventions physically attach the back foot to the front foot or to a machine. This poses a definite safety hazard.
c. Neither of the first two inventions keeps the front toe inverted. This is necessary to insure maximum power upon contact. The third invention allows none other than a 90 degree inversion of the front foot. This is too much inversion in the minds of many coaches.
d. None of the inventions has a numerical guide to aid communication of proper stride length per individual hitter.
e. None of these inventions provide directional information to indicate optimal back foot rotation for pitches at various locations.
f. None of these inventions force the back heel to leave the ground, a necessity which forces the body weight to shift towards the pitch thereby lending power and consistench in making contact with a pitched ball. The third invention, a closed frame, even frustrates back foot rotation when the back foot is placed adjacent to the edge of the frame.

OBJECTS AND ADVANTAGES

Accordingly, the objects and advantages of my invention are:

a. To free both feet from a "tie-down" hindrance, a significant safety feature.
b. To provide an upraised "lip" that is not so tall as to frustrate back foot rotation. As the heel is rotated, it must be raised, thereby insuring foreward weight shift.
c. To provide for and to indicate the various degrees of back foot pivot to insure optimal hip rotation during the swing.
d. To provide a scale to which an instructor can refer when communicating proper stride length to the hitter.
e. To provide a stride regulator to prevent over-striding by the front foot.
f. To provide a stride guide which prevents the lead foot from being moved away from home plate during the swing.

The entire apparatus is easily and quickly used by both left and right-handed hitters. It can serve as a free-standing learning station, in combination with a batting tee or soft-toss drill, or in a batting cage with thrown or pitched balls. Other advantages will become easily apparent upon examination of the enclosed drawings and description.

DRAWING FIGURES

The following drawings depict each part of the invention:

DESCRIPTION—FIGS. 1 TO 5

Figure 1:
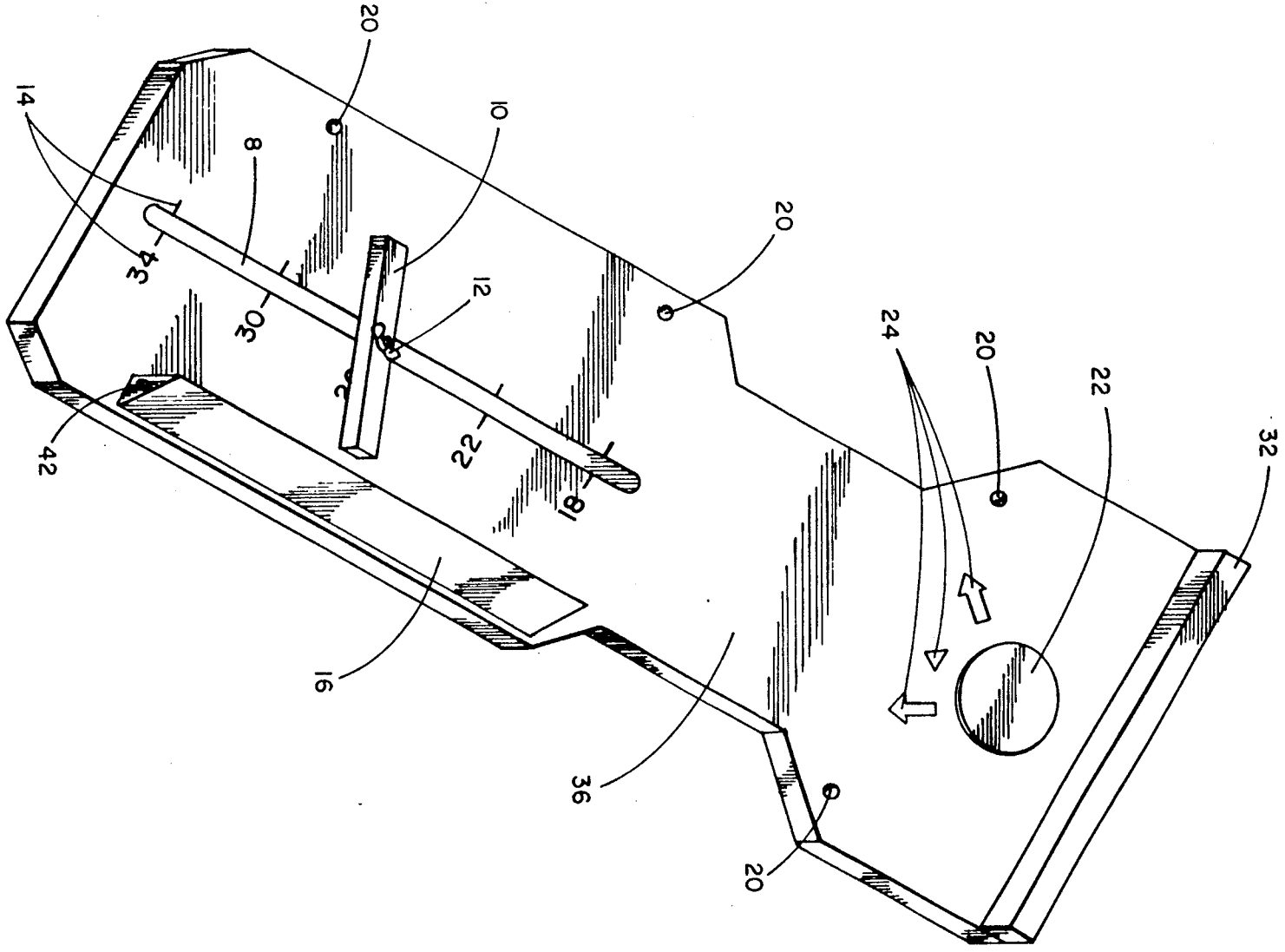
FIG. 1 shows the base and all external parts.
Figure 2:
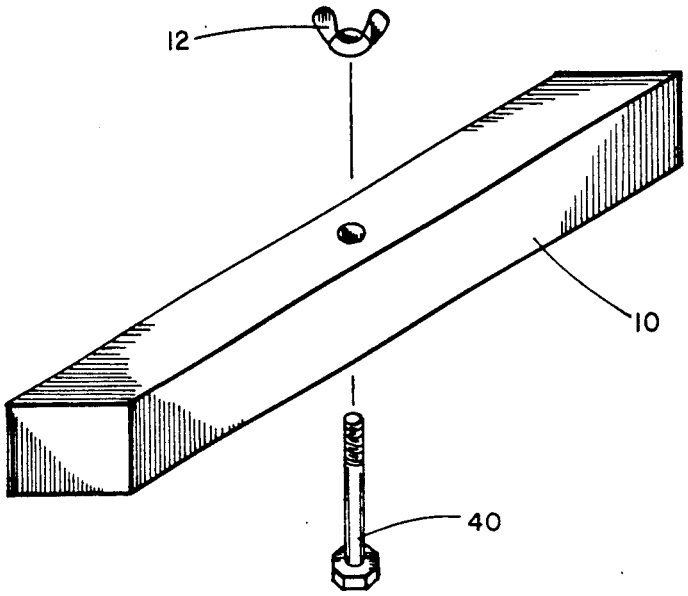
FIG. 2 shows the stride regulator which slides to varying distances and degrees to accomodate hitters of varying body size.
Figure 3:
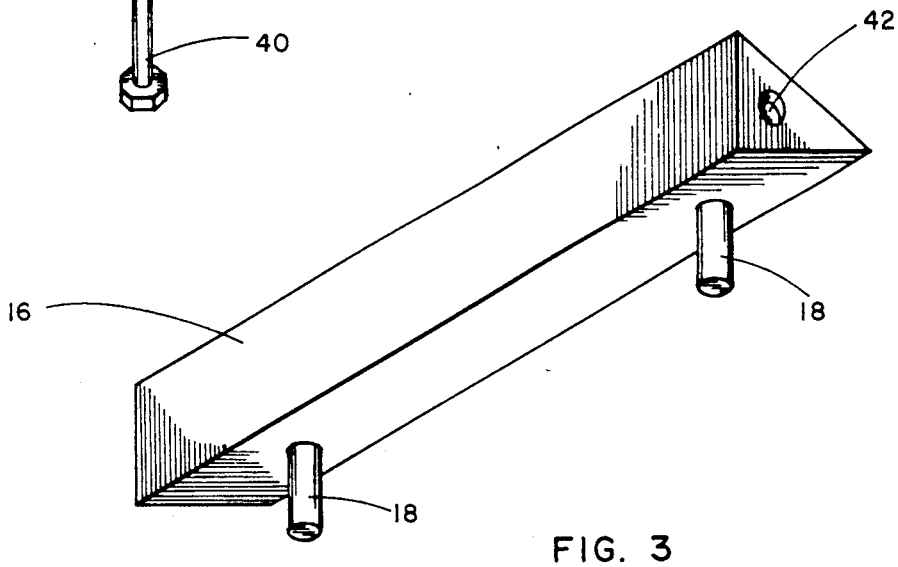
FIG. 3 shows the stride guide which affixes on the base near the edge and prevents to foot from being placed down away from home plate. The guide is moved to either left or right side of the base and either near or away from the rear foot, according to the handedness and size of the hitter.
Figure 4:
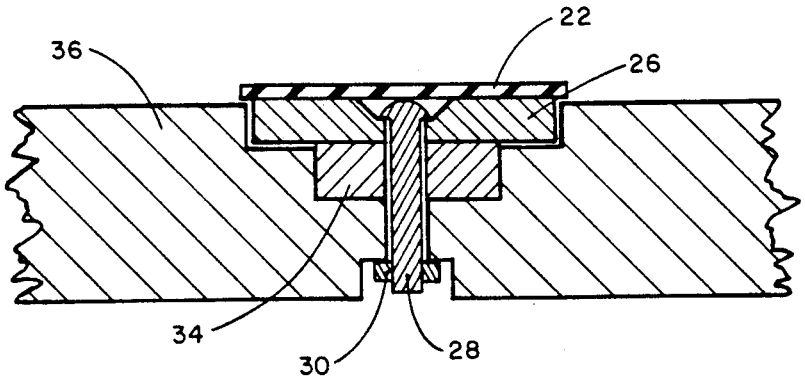
FIG. 4 shows a cross-sectional view of the pivot apparatus for the rear foot.
Figure 5:
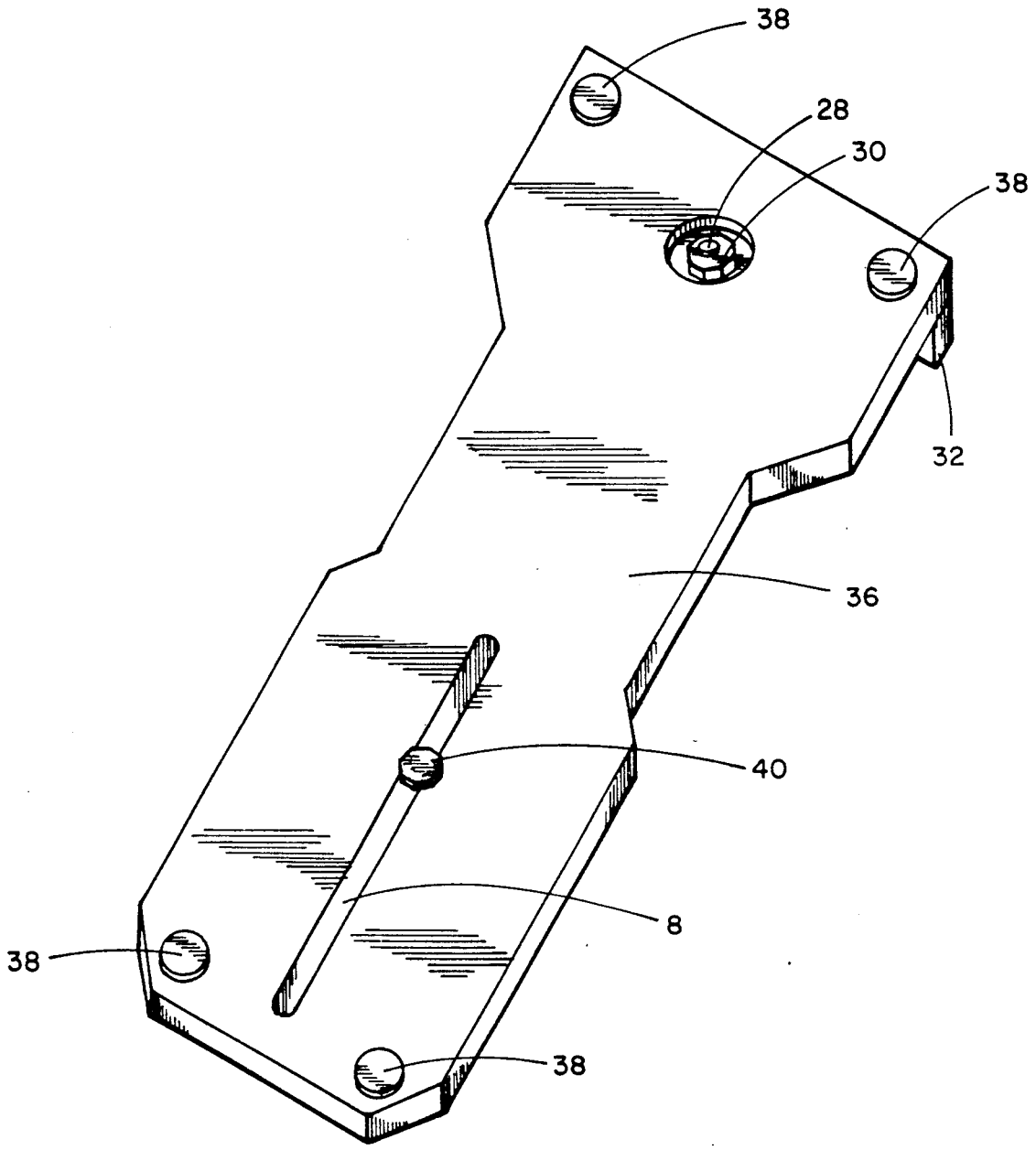
FIG. 5 shows a bottom view of the base.

The resting invention is illustrated in FIG. 1. In order to accomodate both left and right-handed hitters, the base 36 should preferably be at least 20" wide at the pivot end. The base 36 should be at least 16" wide on the opposite end to allow room for the stride guide 16 to be inserted into anchor holes 20 on either side of the base 36. The base 36 itself can be made of wood, rubber, metal, fiberglass, or a polymer material. It can be stained, painted, or coated with a polyurethane finish. Non-skid rubber circles 38 are glued to each of the four corners underneath to prevent slippage on indoor surfaces. The invention may therefore be used outside on grass or dirt surfaces, or indoors on concrete or wooden floors.

A wooden strip 32 at least ½ inch high is glued on the back edge of the base 36 to force the hitter to raise his back heel as he pivots the back foot on the pivot cover 22. The pivot cover 22 is glued to the pivot plate 26 which is set into a 4" routed hole in the base 36. The pivot plate 26 is approximately 1½ inches from the wooden strip 32 at the back edge of the base 36. The pivot cover 22 is made of rubber. It could be made of a polymer or any matted material which would provide traction. The pivot plate 26 is made of wood. It could be made of steel, plastic, or rubber. The wooden strip 32 could also be made of steel, plastic, or rubber, and could even be made retractable along the edge of the base 36.

A thrust bearing 34 is glued underneath the pivot plate 26 and is held in place via a bolt 28 that passes through the hole in its center. The bolt 28 passes through the pivot plate 26 and the lower part of the base 36 and is fastened via a countersunk nut 30. The trust bearing 34 could be a Nice Model 613 or any readily available comparable model. The bolt 28 is approximately ¼ inch in diameter and long enough to pass through the base 36. This distance is approximately 1¾ inches.

The stride regulator 10 is moved along a routed slot 8 to accomodate the leg length of the hitter. A knob 12 secures the regulator 10 via a bolt 40 approximately ¼" in diameter to the surface of the base 36. The bolt 40 slides along the slot 8 to a setting desired by the instructor. The regulator 10 may pivot anywhere from 90 degrees to 0 degrees from the slot 8. It would be possible to cut two slots 8 upon which to slide the regulator 10, or to put dowel pegs in the bottom of the regulator 10 and drill holes in the base 36 at different locations to achieve variable settings. A scale 14 records the numerical setting of the regulator 10. Instructors can therefore suggest optimal stride length in inches.

The stride guide 16 is affixed via its two projecting dowels 18 into holes 20 near the edge of the base 36. The guide 16 is approximately 18" long, at least 1" high, and approximately 1½" wide at the bottom. The guide 16 has small holes 42 routed in each end to faciliate removal from the holes 20 from the base 36. The guide 16 fits on the side of the base 36 corresponding to the side on which the hitter stands. The guide 16 may insert into holes 20 at either of two positions on each side of the base 36. The holes 20 selected depend upon the size of the hitter. The guide 16 could also be affixed on either side of the base 36 and made retractable, or it could be placed in a routed groove on top of the base 36. More dowels 18 could be added and more holes 20 for attachment made available.

In using the invention, the hitter first places the ball of his back foot (the foot further from the pitcher) on the rotating pivot cover 22. The front is spread slightly more than shoulder width and the movable stride regulator 10 is tightened to the base 36 approximately 5–6 inches beyond the front foot. Personal preference dictates whether the stride regulator 10 is set at a 45 degree angle or at a 90 degree angle from the slot 8. The greater the angle, the loss the hips can open prematurely and therefore the less the early loss of power in the swing. The stride guide 16 is placed on the side of the base 36 corresponding to the handedness of the hitter and in the holes 20 corresponding to the size of the hitter.

To initiate the action, a ball may be tossed softly, set on a batting tee, or thrown by a pitching machine or by an actual pitcher. As the hitter swings the bat, he slides his front foot to the limit of the stride regulator 10 and simultaneously raises his back heel to clear the upraised wooden strip 32. In so doing, he rotates the disc cover 22, pivot plate 26, and thrust bearing 34, turning his toe 45 degrees to hit the outside pitch to the opposite field and 90 degrees to pull the inside pitch. Directional marks 24 serve as a check to inform him of success or failure. The stride guide 16 prevents him from putting his foot down away from home plate or "bailing out", which would decrease the odds of making solid contact.

As with the learning of any physical skill, the correct repetition of the action is the key to reinforcing the correct neural pathways and therefore increasing consistency in the hitting stroke.

SUMMARY, RAMIFICATIONS AND SCOPE

Accordingly, the reader can see that the hitter's back foot is free to pivot on the disc 22 and he has a marked indicator 24 to reveal the ideal degree of pivot for each pitch. Additionally, the front foot is prohibited from over-striding, opening too far, or pulling the body away from a pitched ball. A scale 14 reveals the length of stride and is useful to the instructor to refer to the ideal stride distance for each hitter. The back heel must be raised to thrust the weight foreward toward the pitch, thereby increasing power in the swing.

Although the description above is very specific, these specifications should not be construed as limiting the scope of the invention. For example, a rubber mat could be used to cover part or all of the base 36 and the numerals 14 may or may not be cut into the mat to indicate stride length. The mat would enable spiked shoes to be used on the invention.

Therefore the scope of the invention should be determined by the claims and their legal equivalents, rather than by the example that is given.

I claim:

1. A baseball batting training apparatus comprising: a base means having upper and lower planar surfaces for accommodating the feet of hitter; adjustable stride length regulating means attached to said base means upper surface for adjustably limiting the hitting stride of a batter when executing a proper bat syringing motion stride guide means attached to said base adjacent said stride length regulating means for guiding a hitter's front foot when the hitter moves in a forward direction during said bat swinging motion; pivot means attached to said base for facilitating rotation of a batter's back foot during said bat swinging motion; means attached to said base adjacent said pivot means for causing a batter to raise the heel of his back foot during rotation of the back foot on said pivot means while executing said bat swinging motion.

2. The training apparatus as defined in claim 1, wherein, said base means has a substantially rectangular configuration and having front and rear ends; said stride length regulating means being an elongated vertically extending planar member attached to said base means adjacent said front end; said stride guide regulating means being adjustably attached to said base means by an elongated slot and bolt, said slot extending from adjacent said front end a predetermined distance along the longitudinal axis of said base, said stride length regulating means being adjustable along said slot and positioned substantially perpendicular to said longitudinal axis when in use.

3. The training apparatus as defined in claim 2, wherein, said pivot means a disk rotatably attached to said base means adjacent said rear end, and said means adjacent said pivot means is an elongated vertically extending planar member extending transversely across said base means at said rear end.

4. The training apparatus as defined in claim 1, wherein, said stride guide means is an elongated vertically extending planar member attached along a longitudinal edge of said base means and adjacent one end of said stride length regulating means.

* * * * *